US009950227B1

(12) United States Patent
Faircloth

(10) Patent No.: US 9,950,227 B1
(45) Date of Patent: Apr. 24, 2018

(54) GOLF BALL AND TEE SETTING AND RETRIEVING DEVICE

(71) Applicant: Timothy K Faircloth, Pensacola, FL (US)

(72) Inventor: Timothy K Faircloth, Pensacola, FL (US)

( * ) Notice: Subject to any disclaimer, the term of this patent is extended or adjusted under 35 U.S.C. 154(b) by 0 days.

(21) Appl. No.: 15/682,640

(22) Filed: Aug. 22, 2017

Related U.S. Application Data

(60) Provisional application No. 62/544,790, filed on Aug. 12, 2017.

(51) Int. Cl.
*A63B 57/00* (2015.01)
*A63B 37/00* (2006.01)

(52) U.S. Cl.
CPC ..... *A63B 57/0037* (2013.01); *A63B 37/0003* (2013.01)

(58) Field of Classification Search
CPC ..... A63B 57/0037
USPC ..... 473/386
See application file for complete search history.

(56) References Cited

U.S. PATENT DOCUMENTS 2,609,198 A 9/1952 Armstrong
2,834,629 A 6/1958 Mims
3,527,492 A 9/1970 Moms
3,669,427 A 6/1972 Curtis
4,466,650 A 8/1984 Roedel
4,616,826 A * 10/1986 Trefts ..... A63B 57/0037 294/116
4,714,250 A 12/1987 Menthem
4,819,938 A 4/1989 Hill
4,949,961 A 8/1990 Milano
5,080,357 A * 1/1992 Wolf ..... A63B 57/0037 294/115
5,330,177 A * 7/1994 Rogge ..... A63B 47/02 294/19.2
5,503,394 A 4/1996 Mauck et al.
5,632,696 A * 5/1997 Nichols ..... A63B 57/0037 473/386
5,669,646 A 9/1997 Fiocca et al.
5,672,121 A 9/1997 Miller
5,707,303 A 1/1998 Berkowitz et al.
5,772,533 A 6/1998 Dahlmann
5,839,972 A 11/1998 Swanson
6,338,685 B1 * 1/2002 Posluszny ..... A63B 57/0037 473/386

(Continued)

*Primary Examiner* — Steven Wong
(74) *Attorney, Agent, or Firm* — George L Williamson

(57) ABSTRACT

A device is disclosed for setting a golf ball and tee in the ground and then for retrieving the golf ball and tee. The device has a handle end for being held in the hand of a user along with a ball pick-up end which engages a golf ball and tee so that the golf ball and the tee can be placed in the ground and then picked up. The handle end also has a trigger which is used to operate arms located at the pickup end which arms engage the ball and tee wherein a first rod connects the trigger to the arms of the pickup end. The first rod passes through a shaft and connects the trigger to the arms. An adjuster in the handle end operates a second rod which also passes through the shaft which controls a ball cup which is used to set the ball onto the tee which tee is then placed in the ground. Additionally, a stand is provided for insertion into the ground so that the device can be held in an upright position for being easily grasped by a user.

20 Claims, 4 Drawing Sheets

(56) References Cited

U.S. PATENT DOCUMENTS

| | | | | |
|---|---|---|---|---|
| 6,394,515 | B1 | 5/2002 | Keleher et al. | |
| 6,672,977 | B1 | 1/2004 | Colbo et al. | |
| 6,843,737 | B1 * | 1/2005 | Smith | A63B 57/0037 473/386 |
| 7,713,136 | B1 | 5/2010 | Colucci | |
| 7,963,854 | B2 | 6/2011 | Nugent | |
| 8,529,379 | B1 | 9/2013 | Faircloth | |
| 2003/0203772 | A1 * | 10/2003 | Paine | A63B 57/0037 473/386 |
| 2004/0029653 | A1 * | 2/2004 | Whitehill | A63B 57/0037 473/386 |
| 2007/0021239 | A1 * | 1/2007 | Gates | A63B 57/0037 473/386 |
| 2008/0146367 | A1 | 6/2008 | Cruz | |

* cited by examiner

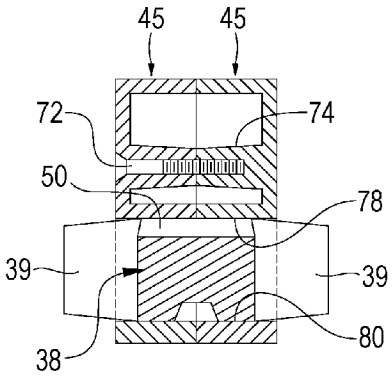
FIG. 5
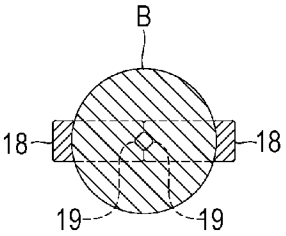
FIG. 6
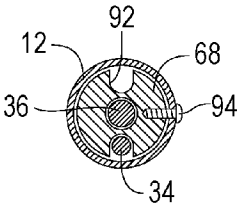
FIG. 7
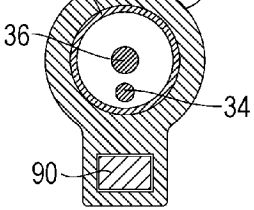
FIG. 8
FIG. 9
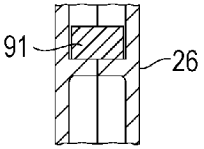
FIG. 10

GOLF BALL AND TEE SETTING AND RETRIEVING DEVICE

RELATED APPLICATIONS

This application claims benefit of U.S. Provisional Patent Application No. 62/544,790 filed on Aug. 12, 2017.

BACKGROUND OF THE INVENTION

Field of the Invention

The present invention relates generally to accessories for the game of golf, and, more particularly, is concerned with a golf ball and tee setting and retrieving device.

DESCRIPTION OF THE RELATED ART

Devices relevant to the present invention have been described in the related art, however, none of the related art devices disclose the unique features of the present invention.

An Information and Disclosure Statement by applicant is being submitted with this specification. In addition, the following discussion of the background of the game of golf and related art thereto is provided.

The game of golf is a timeless game that is played by the young and the young at heart. Unlike more vigorous sports, such as basketball, soccer, or tennis, peak physical shape is not a prerequisite for playing a solid round of golf. Although golf can be played throughout one's life, even during one's later years as a person's health declines, certain aspects of the game can make playing a round of golf difficult and much less fun.

During the start of each hole, the ball is teed up and driven toward the pin. The golfer bends over and inserts the tee into the ground at a desired depth of insertion, places the ball onto the tee, and hopefully shoots a beauty straight down the middle of the fairway. Thereafter, the tee, or at least what's left, is retrieved and the game continues. Additionally, after the ball is sunk, the ball is retrieved from the cup and the golfer proceeds to the next hole. While these before and after round functions are routine for most golfers, they can be unbearably painful if not outright impossible for golfers who have certain ailments. A golfer with bad hips, knees, or back, due to such causes as arthritis, injury, or simple old age, may be able to hit the ball with reasonable force, yet be unable to bend down to tee up the ball or to retrieve the tee or the ball from the cup, without serious discomfort, to the point that the round of golf may cause more pain than enjoyment.

Some golfers overcome such limitations by hiring a caddy for a round of golf and rely on the caddy to perform any tasks that require bending over. However, not only are caddies expensive, very few courses maintain a stable of caddies. Some golfers rely on other members in the golfer's party to perform the tasks that that ailing golfer cannot easily perform. However, such reliance can be quite embarrassing for the affected golfer, and is not a solution for a golfer playing a solo round or for a golfer practicing on the driving range.

To address the problem of a golfer's difficulty in bending down to tee up and retrieve balls, devices have been proposed that allow a golfer to set a tee and place a ball onto the tee and retrieve each as needed, all from a standing position. Many modern interpretations of such devices rely on a "grabber arm" architecture wherein two or more grabber fingers at a distal end of the device are opened and closed via a golfer-controlled handle located at the proximal end of the device. The ball or tee or both are grabbed by the fingers of the grabber arm and are positioned as needed. While such devices allow a golfer with certain physical limitation to enjoy a game of golf, such devices are not without their drawbacks.

Many such devices, while generally effective, are unduly complex in design so that manufacture of such device is relatively expensive, thereby narrowing the potential consumer market for such devices. Some devices are awkward to control so that grasping of the generally spherical ball can be tricky. Additionally, the prior art devices do not allow precision of the depth of tee insertion into the ground per the golfer's desired depth. While the tee can be eventually manipulated to the approximate desired height, such manipulation is awkward.

What is needed is a device that allows a golfer to be able to insert a tee into the ground at a desired depth of insertion and place a golf ball onto the tee for hitting, with the device allowing retrieval of the tee and ball as needed. Such a device must be of relatively simple design so as to be relatively inexpensive to produce so as to be affordable for a larger segment of the consumer market for such devices. Such a device must be easy to operate so that grasping of the spherical ball is quick and easy without undue drops or slips.

While these devices may be suitable for the purposes for which they were designed, they would not be as suitable for the purposes of the present invention as hereinafter described. As will be shown by way of explanation and drawings, the present invention works in a novel manner and differently from the related art.

SUMMARY OF THE PRESENT INVENTION

The present invention discloses a device for setting a golf ball and tee in the ground and then for retrieving the golf ball and tee. The present invention has a handle end for being held in the hand of a user along with a ball pick-up end which engages a golf ball and tee so that the golf ball and the tee can be placed in the ground and then picked up. The handle end also has a trigger which is used to operate arms located at the pickup end which arms engage the ball and tee wherein a first rod connects the trigger to the arms of the pickup end. The first rod passes through a shaft and connects the trigger to the arms. An adjuster operates a second rod which also passes through the shaft which controls a ball cup which is used to set the ball onto the tee which tee is then placed in the ground. Additionally, a stand is provided for insertion into the ground so that the device can be held in an upright position so that it can be easily grasped by a user.

An object of the present invention is to provide a device for setting a golf ball and a tee in the ground and then for retrieving the golf ball and tee. A further object of the present invention is to provide a device which can be used to pick up a golf ball and tee without the user having to bend over to do so. A further object of the present invention is to provide a device which can be easily operated by a user. A further object of the present invention is to provide a device which can be relatively easily and inexpensively manufactured.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views. The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which:

FIG. 5 is a cross-sectional view taken generally along line 5-5 of FIG. 2.

FIG. 6 is a cross-sectional view taken generally along line 6-6 of FIG. 1.

FIG. 7 is a cross-sectional view taken generally along line 7-7 of FIG. 2.

FIG. 8 is a cross-sectional view taken generally along line 8-8 of FIG. 3.

FIG. 9 is a cross-sectional view taken generally along line 9-9 of FIG. 2.

FIG. 10 is a cross-sectional view taken generally along line 10-10 of FIG. 2.

LIST OF REFERENCE NUMERALS

Figure 1:
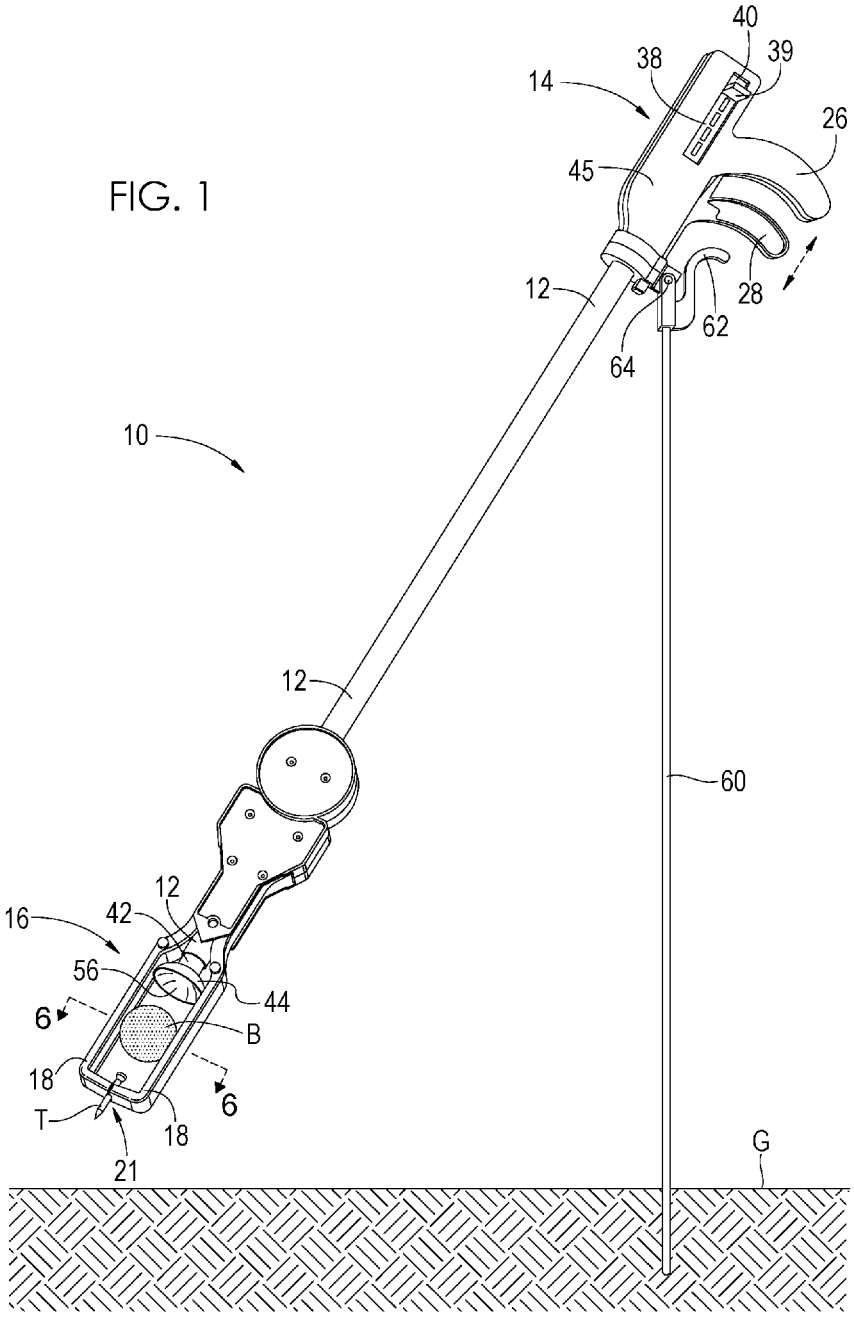
FIG. 1 is a perspective view showing the present invention supported in an upright position by the stand.

With regard to reference numerals used, the following numbering is used throughout the drawings.

10 present invention
12 main shaft
14 proximate end of main shaft
16 distal end of main shaft
17 indicia
18 arms of ball catch
19 slot
20 first end of ball catch
21 collar
22 second end of ball catch
23 push pull member
24 pivot point of arm
26 handle
28 trigger
30 inclined contact
34 first rod
36 second rod
38 adjuster
39 thumb tab
40 proximate end of adjuster
42 distal end of adjuster
44 ball cup
45 cover/housing
46 latching catch
48 pawl-like member
50 linear rack
51 spring
52 spring for push pull
56 concave end
58 mounting end
60 support leg
62 finger grip
64 pivot
66 spring
68 bushing
70 bushing
72 screw
74 screw receptacle
76 cover
78 upper surface of channel
80 lower surface of channel
82 aperture
84 foot
86 clip receptacle
88 collar-like member
90 forward projecting member
91 rearward projecting member
92 indention
94 fastener
96 push protrusion
98 pull protrusion
B golf ball
T golf tee
G ground

DESCRIPTION OF THE PREFERRED EMBODIMENTS

The following discussion describes in detail at least one embodiment of the present invention. This discussion should not be construed, however, as limiting the present invention to the particular embodiments described herein since practitioners skilled in the art will recognize numerous other embodiments as well. FIGS. 1 through 10 illustrate the present invention wherein a golf ball and tee setting and retrieving device is disclosed and which is generally indicated by reference number 10.

Figure 2:
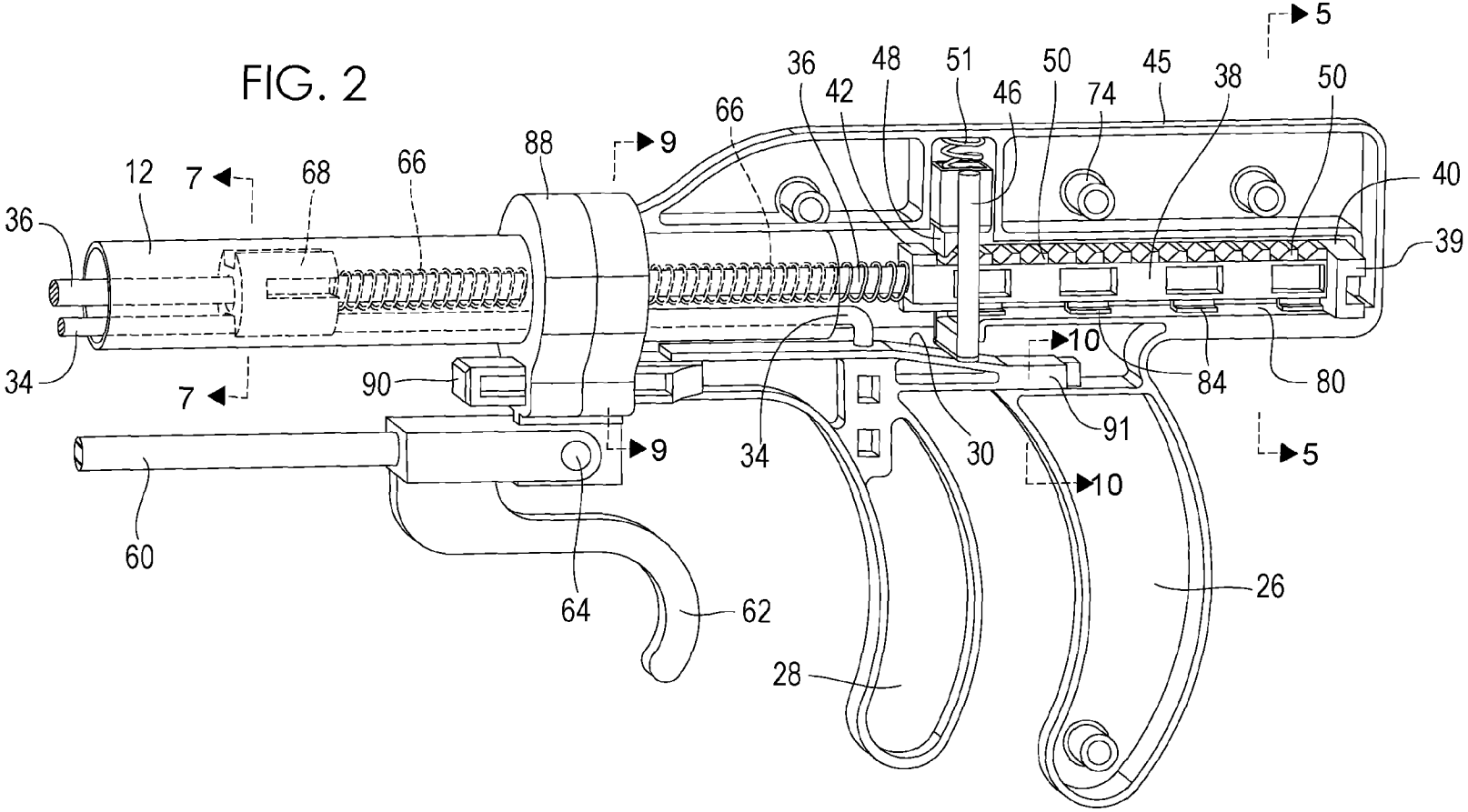
FIG. 2 is a perspective view of the interior of the proximate end of the present invention.
Figures 3, 4:
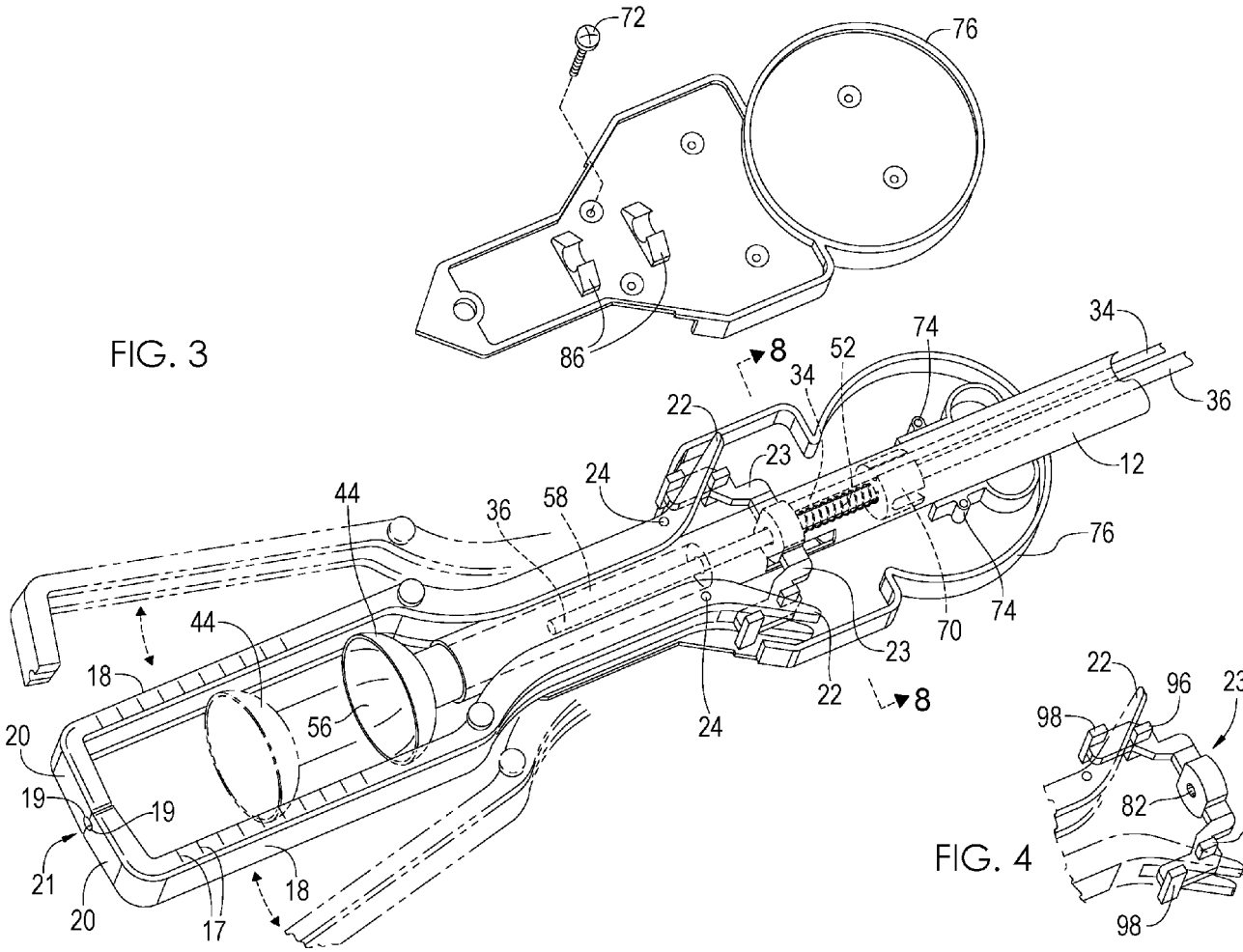
FIG. 3 is a perspective view of the distal end of the present invention including the interior of the distal end.
FIG. 4 is a perspective view of a portion of the present invention.

Turning to FIGS. 1-10, therein is shown the golf ball and tee setting and retrieving device of the present invention 10 having a generally hollow main shaft 12 having a proximal end 14 where a handle assembly including handle 26 is disposed for being held in a hand of a user and a distal end 16 for picking up a golf ball B and tee T. Also shown is an outer or first ball catch having two or more first opposing arms 18 that are pivotally attached at pivot points 24 to the main shaft 12 proximate the distal end 16. Each of the first arms 18 has opposing first ends 20 and second ends 22, such that the pivotal point of attachment 24 of the first arms 18 to the main shaft 12 is between first end 20 and the second end 22 of each first arm 18 but closer to the second end 22. The first end 20 of each first arm 18 is turned inwardly about ninety degrees toward each other end and has semi-circular opposing slots 19 so as to substantially form a collar 21 to encircle the tee T so as to be able to firmly grab the shaft of a golf tee T whenever the arms 18 are brought together. Arms 18 may also include optional indicia 17. The slots 19 are sized and shaped for picking up conventional golf balls B that are currently being marketed. Each pivot point of attachment 24 is biased by spring 52 pushing through the push pull member 23 contacting end 22 so as to normally bias the first ends 20 of the arms 18 together or in the closed position. Spring 52 has its upper end abutting bushing 70 and is biased toward arms 18. FIG. 3 also shows a cover half 76 exploded away and fastener or screw 72 for attaching the cover to the other cover half using a plurality of screw receptacles or mounts 74 or the like. Also FIG. 3, illustrates movement of the arms 18 and ball cup 44 using phantom lines. FIG. 4 shows the push pull member 23 having an aperture 82 therein through which rod 36 freely passes along with push protrusion 96 which pushes second end of ball catch 22 and thus arms 18 to a closed position and pull protrusion 98 which pulls second end of ball catch 22 and thus arms 18 to an open position.

A handle 26 is located on the proximal end 14 of the main shaft 12 while an upper portion of the trigger 28 is slidably attached to a first rod 34 which is attached to the trigger 28 and also to the second end 22 of each arm 18 using push pull member 23, the first rod 34 passing along an outer indention or channel 92 of bushings 68, 70 disposed in the interior of the main shaft 12 and may or may not exit out of the main shaft 12 through appropriate openings located proximate the second end 22 of each arm 18. Whenever the trigger 28 is squeezed toward the handle 26, the rearwardly traveling position (positioned toward the proximal end 14 of the main shaft) trigger 28 pulls on the first rod 34 causing it to partially retract into the main shaft 12 which pivots the second end 22 of each arm 18 toward the main shaft 12 so as to spread the first ends 20 of the fingers 18 apart thereby opening the first ball catch. Whenever the trigger 28 is in the released position, the fingers 18, either via the spring-loaded attachment of fingers 18 to main shaft 12 (or each other), or spring-loaded trigger 28 causes the first ends 20 of the arms 18 to be brought back together, thereby closing the ball catch which ball catch is substantially the same width as the diameter of a convention ball B so as to loosely secure the ball on the inside of the arms 18. Also, spring 52 is biased toward distal 16 and keeps catch 18, 20 closed.

An adjuster 38 also has a proximal end 40 and a distal end 42 wherein a portion of the distal end 42 is connected to a second rod 36 which is slidably disposed within bushings 68, 70 disposed within the main shaft 12 such that the proximal end 40 of the adjuster 38 has a thumb tab 39 which extends outwardly or laterally away from the longitudinal center line of the adjuster 38 so that a thumb of a user can easily rest on the thumb tab 39 allowing a user to control the adjuster 38. The distal end of the second rod 36 extends outwardly from the distal end 16 of the main shaft 12 and has a ball cup 44 thereon. A cover 45 is located on the proximal end of the main shaft 12 such that the adjuster 38 passes through the cover 45 and such that the adjuster engages a catch or latching catch 46 so as to allow controlled positioning of the adjuster 38 with respect to the main shaft 12. Only one side or half of cover 45 is shown in FIG. 2 wherein the near side cover is removed to show the inside of the proximate end 14; FIG. 5 shows both halves of cover 45. The latching catch 46 can be movable positioned in the cover 45 such that moving of the adjuster 38 in one direction moves the second rod 36 so as to lock the second rod 36 in position with respect to the main shaft 12 and moving adjuster 36 in the opposite direction causes the adjuster 38 to allow the second rod 38 to slide relative to the main shaft 12. Trigger 28 has a gently sloping or inclined upper surface forming a contact surface 30 for contacting a lower end of latching catch 46 for moving the catch 46 up or down so that when the trigger is pulled toward the rear position catch 46 is in an upward position and when the trigger is in the forward position catch 46 is in a downward position. The downwardly extending body of the trigger 28 is constructed and configured so as to not interfere with the second rod's 36 position within the main shaft 12 due to being mounted below the main shaft 12. Trigger 28 slides back and forth and is secured to the handle assembly by having a forwardly projecting member 90 which passes through an aperture in a collar-like member 88 which surrounds shaft 12 along with a rearwardly projecting member 91 which slides on a horizontal surface of handle 26. Collar-like member 88 is disposed on a front portion of cover/housing 45. Rod 36 floats or passes unobstructed through the center aperture of bushings 68, 70 and spring 52 does not affect rod 36. Bushing 68 guides rod 36 and provides a stop for spring 66 on its lower end so that spring 66 is biased toward the proximate end 40 of adjuster 38. In general, bushing 68, 70 serve as a positioning guide for rods 34, 36 providing unhindered movement thereof and serves as a stop for spring 52 and 66 as the bushings are fixedly attached to and positioned internal shaft 12 using an exemplary fastener 94, e.g., a screw, or other means such as brads, rivets, glue, or the like or could be molded into the main shaft 12 or otherwise positioned. Adjuster 38 has a plurality of feet 84 on its underside which feet slide on a surface of lower channel 80.

A thumb tab 39 is located on the proximal end 40 of the adjuster 38, which tab 39 acts as a grasping element for being grasped by the thumb of a user. Also shown is a linear rack having a series of teeth 50 similar to a conventional linear rack or the like is positioned on the adjuster 38 so as to make contact with a downwardly extending pawl or pawl-like member 48 on latching catch 46 such that when the rack 50 moves forwardly (toward distal end) pawl 48 slides up and down over the gently sloped teeth with spring 51 forcing the pawl into the depressions between the teeth but when rack 50 moves rearwardly (toward proximate end) the pawl will catch against the steeply sloped edge of the rack teeth to prevent further movement in that direction.

A ball cup 44 is located on the distal end 42 of the second rod 36. The ball cup 44 has a I1 concave first end 56 that can grasp and hold a conventional golf ball B and a second mounting or connecting end 58 attached to the second rod 36. Whenever the trigger 28 is squeezed, the first rod 34 is pulled rearwardly causing the push pull member 23 to be pulled rearwardly which causes each of the first end 20 of ball catch 18 to pivot to an open position. Release of the trigger 28 allows the spring 52 to force the push pull 23 to return to its normal relaxed position and thereby allows the arms 18 of the ball catch to close.

Turning to FIG. 5, therein is shows a cross-sectional view taken generally as indicted from FIG. 2, showing the two halves of cover 45 which would be joined together using a plurality of fasteners, e.g., screws 72 or the like, mating into screw receptacles or mounts 74 showing the adjuster 38 being slidably disposed in a channel or track including an upper 78 and lower 80 surface of the channel. Other previously disclosed elements are also shown.

Turning to FIG. 1, also a support leg 60 is pivotally attachable at 64 to the main shaft 12 and is capable of folding outwardly therefrom in order to allow the device 10 to be supported on the ground G in tripod fashion. A finger grip 62 can be grasped by a finger of the user to operate support leg 60 which leg may be secured to cover 76 using clip receptacle 86.

A short summary of use of the present invention follows: A user stands upright and holds the present invention 10 with distal end 16 upright and loads ball B and tee T into ball slide or cup 44 and ball catch 18. Next, adjust the adjuster 38 with a thumb on the thumb tab 39 so that ball cup 44 is set to the correct height. Turn the present invention 10 so that the distal end 16 is in the downward position, press tee T into the ground G until the ball catch 18 is flush with the ground G and squeeze the trigger 28 to release ball B and tee T and move the end 20 away to clear ball B and tee T, pull leg 60 out and stick into the ground G. When picking the ball B up out of the hole, simply put the end 20 of the present invention 10 into the hole and scoop the ball B till the ball slides into the ball catch 18 and pull upwardly; the ball B is then retrieved from the present invention 10 and a player moves on to the next hole, all of this while standing in the upright position.

A more detailed explanation of how to use the golf ball and tee setting and retrieving device 10 of the present invention follows: The device 10 is positioned so that the ball cup 44 is overtop a ball B and the arms 18 overtop a tee T (ball cup 44 is slightly larger in diameter than ball B and there is no suction on the ball B and when the device is held upright gravity holds the ball B against tee T). The trigger 28 is squeezed so as to open the arms 18. The device 10 is manipulated so that the arms 18 pick up the tee T and ball cup 44 picks up the ball B. The tee T is positioned as desired and pushed into the ground G until the arms 18 hit the ground G. As the adjuster 38 is set at the desired position with respect to the main shaft 12, the ball B height above the ground G is set as desired by the golfer. The trigger 28 is once again squeezed in order to open the arms 18 so as to release the arms grip on the tee T, which is secure in the ground G, and the arms are moved laterally away from the tee and ball. The linear rack 50 or other indicia on the adjuster 38 or arms 18 may aid the golfer in assuring that the ball B is at the proper height. Once the shot is taken, the tee T is retrieved via the arms 18 of the main shaft 12 by picking up the tee using collar 21. When the ball B is in a cup, or other pickup location, the arms 18 are opened and used to retrieve the ball B.

Additional explanation of the features and use of the present invention 10 follows: when one pulls the trigger 28 to the rear, the adjuster 38 is freed from latch 46 which pulls ball cup 44 up and opens the arms 18 so that after the adjuster is released and spring 66 is relaxed, then additional pulling on the trigger would only move the arms. The adjuster 38 only moves ball cup 44 toward the tee T by using thumb tab 39. Tab 39 sticks out on both sides of the handle cover 45 for operation by either a left or right-handed person so that a user can operate the adjuster with either a thumb or off hand. The present invention 10 is designed to accommodate the longest conventional tees T that are currently used. A user can select a tee T height by generally referencing the adjuster 38 to the handle 26 and of tee is chosen from linear rack notches and optionally indicia 17 may be placed near the handle or the edges of the arms 18 so a player can reference the indicia to place the ball B and tee T so that they exhibit a consistent height and this may include numbers or lines. The device 10 was designed so that a user can pick up the tee T in a customary way between index and middle fingers and then hold ball B with thumb against the cup end of the tee and place the tee in arm tip collar 21 and hold and push adjuster 38 toward distal end and adjust height of ball B and tee T to your preference.

The golf ball and tee setting and retrieving device 10 can be carried in the golfer's bag or on the cart or other appropriate place. Alternately, or in addition, the support legs 60 can hold the device 10 in an upright position whenever the golfer is taking a shot. In this way, the golfer can place and retrieve tees T, can place a ball B onto the tee T and retrieve the ball B from the cup (or from the rough, from water, etc.,) hold a club, and otherwise remain upright so that the golfer can play an entire round of golf without the need to ever bend over.

The following detailed summary making reference to FIG. 1-10 discloses a golf ball B and tee T setting and retrieving device 10, including a) a hollow main shaft 12 having a handle assembly on a proximate end 14 thereof and a setting and retrieving assembly on a distal end 16 thereof; b) the setting and retrieving assembly comprising a pair of arms 18 pivoting at 24 between a closed position supporting a tee extending therefrom and enclosing a golf ball, and an open position releasing said tee and golf ball; c) the setting and retrieving assembly including a first spring 52 extending from a first bushing 70 mounted within the hollow main shaft to a push pull member 23 within the hollow main shaft connected to the pair of arms for biasing the pair of arms into the closed position; d) the handle assembly comprising a housing 45 having a handle 26, and a trigger 28 extending from the housing; e) a first slidable rod 34 extending through the hollow main shaft attached at a proximate end thereof to the trigger, the first rod extending to the push pull member for urging the pair of arms into the open position when the trigger is pulled; f) a ball cup 44 enclosed by the pair of arms for engaging the golf ball; g) a second slidable rod 36 having a distal end connected to the ball cup extending through the hollow main shaft to and terminating at an adjuster 38 for setting a correct height of the ball cup, the adjuster located adjacent the proximate end of the hollow shaft within the handle assembly; h) a second bushing 68 mounted adjacent the handle assembly within the hollow main shaft; i) a second spring 66 having a distal end attached to the second bushing for biasing the second spring and a proximal end attached to the adjuster, the adjuster moving the second slidable rod within the hollow main shaft for selecting a desired height of the ball cup; j) the first and second bushings serving as positioning guides for the first and second rods, provide unhindered movement of the first and second rods, and serve as stops for the first and second springs, respectively; and, k) wherein the pair of arms are adapted to place the tee in the ground with the golf ball atop the tee and to retrieve the tee from the ground G so that a user avoids bending over. Further, in which the first and second rods pass through said first and second springs. Further, in which the adjuster is a slidable member with a first end engaged with a proximate end of the second rod and a second end having a thumb tab 39 for positioning the slidable member, and a catch 46 for locking the slidable member in a desired position of the slidable member and thereby the desired height of the ball cup. Further, in which the slidable member includes a linear toothed rack 50, a pawl 48 for engaging the linear toothed rack, and a spring 51 for locking the pawl into engagement with the linear toothed rack. Further, in which a pivotable support leg 60 extends from an outer surface of the hollow main shaft, the support leg having a finger grip 62 for positioning the support leg. Further, in which a portion of the setting and retrieving assembly is enclosed within a cover 76. Further, in which the ball cup has a concave surface 56 to engage the golf ball, the concave surface being enlarged so as to only loosely engage the golf ball. Further, in which distal ends 20 of the pair of arms are turned inwardly about ninety-degrees toward each other with facing semi-circular slots 19 to substantially form a collar to encircle the golf tee so as to be able to firmly grab a shaft of the golf tee.

I claim:

1. A golf ball and tee setting and retrieving device, comprising:

a) a hollow main shaft having a handle assembly on a proximate end thereof and a setting and retrieving assembly on a distal end thereof;

b) said setting and retrieving assembly comprising a pair of arms pivoting between a closed position supporting a tee extending therefrom and enclosing a golf ball, and an open position releasing said tee and golf ball;

c) said setting and retrieving assembly including a first spring extending from a first bushing mounted within said hollow main shaft to a push pull member within said hollow main shaft connected to said pair of arms for biasing said pair of arms into said closed position;

d) said handle assembly comprising a housing having a handle, and a trigger extending from said housing;

e) a first slidable rod extending through said hollow main shaft attached at a proximate end thereof to said trigger, said first rod extending to said push pull member for urging said pair of arms into said open position when said trigger is pulled;

f) a ball cup enclosed by said pair of arms for engaging said golf ball;

g) a second slidable rod having a distal end connected to said ball cup extending through said hollow main shaft to and terminating at an adjuster for setting a correct height of said ball cup, said adjuster located adjacent the proximate end of said hollow shaft within said handle assembly;

h) a second bushing mounted adjacent said handle assembly within said hollow main shaft;

i) a second spring having a distal end attached to said second bushing for biasing said second spring and a proximal end attached to said adjuster, said adjuster moving said second slidable rod within said hollow main shaft for selecting a desired height of said ball cup;

j) said first and second bushings serving as positioning guides for said first and second rods, provide unhindered movement of said first and second rods, and serve as stops for said first and second springs, respectively; and k) wherein said pair of arms are adapted to place the tee in the ground with the golf ball atop the tee and to retrieve the tee from the ground so that a user avoids bending over.

2. The device of claim 1, in which said first and second rods pass through said first and second springs.

3. The device of claim 1, in which said adjuster comprises a slidable member with a first end engaged with a proximate end of said second rod and a second end having a thumb tab for positioning said slidable member, and a catch for locking said slidable member in a desired position of said slidable member and thereby the desired height of said ball cup.

4. The device of claim 3, in which said slidable member includes a linear toothed rack, a pawl for engaging said linear toothed rack, and a spring for locking said pawl into engagement with said linear toothed rack.

5. The device of claim 1, in which a pivotable support leg extends from an outer surface of said hollow main shaft, said support leg having a finger grip for positioning said support leg.

6. The device of claim 1, in which a portion of said setting and retrieving assembly is enclosed within a cover.

7. The device of claim 1, in which said ball cup has a concave surface to engage a golf ball.

8. The device of claim 1, in which distal ends of said pair of arms are turned inwardly about ninety-degrees toward each other with facing semi-circular slots to substantially form a collar to encircle the golf tee so as to be able to firmly grab a shaft of the golf tee.

9. A method for setting and retrieving a golf ball tee and golf ball, comprising the steps of:

a) providing a hollow main shaft having a handle assembly on a proximate end thereof and a setting and retrieving assembly on a distal end thereof;

b) providing a pair of arms on the setting and retrieving assembly pivoting between a closed position supporting a tee extending therefrom and enclosing a golf ball, and an open position releasing the tee and golf ball;

c) providing a first spring on the setting and retrieving assembly extending from a first bushing mounted within the hollow main shaft to a push pull member within the hollow main shaft connected to the pair of arms for biasing the pair of arms into the closed position;

d) providing a handle on the handle assembly and a trigger extending from the housing;

e) providing a first slidable rod extending through the hollow main shaft attached at a proximate end thereof to the trigger, the first rod extending to the push pull member for urging the pair of arms into the open position when the trigger is pulled;

f) providing a ball cup enclosed by the pair of arms for engaging a golf ball;

g) providing a second slidable rod having a distal end connected to the ball cup extending through the hollow main shaft to and terminating at an adjuster, and using the adjuster for setting a correct height of the ball cup, the adjuster located adjacent the proximate end of the hollow shaft within the handle assembly;

h) providing a second bushing mounted adjacent the handle assembly within the hollow main shaft;

i) providing a second spring having a distal end attached to the second bushing for biasing the second spring and a proximal end attached to the adjuster, and moving the adjuster to position the second slidable rod within the hollow main shaft for selecting a desired height of the ball cup;

j) using the first and second bushings to serve as positioning guides for the first and second rods, and to provide unhindered movement of the first and second rods, and to serve as stops for the first and second springs, respectively; and k) using the pair of arms to place the tee in the ground with the golf ball atop the tee and to retrieve the tee from the ground so that a user avoids bending over.

10. The method of claim 9, in which the first and second rods pass through the first and second springs.

11. The method of claim 9, in which the adjuster is configured for sliding and having a first end engaged with a proximate end of the second rod and a second end having a thumb tab for positioning the adjuster, and catch for locking said adjuster in a desired position of the adjuster and thereby the desired height of the ball cup.

12. The method of claim 11, in which the adjuster includes a linear toothed rack, a pawl for engaging the linear toothed rack, and a spring for locking the pawl into engagement with the linear toothed rack.

13. The method of claim 9, in which a pivotable support leg extends from an outer surface of the hollow main shaft, the support leg having a finger grip for positioning of the support leg.

14. The method of claim 9, in which a portion of the setting and retrieving assembly is enclosed within a cover.

15. The method of claim 9, in which said ball cup has a concave surface to engage a golf ball.

16. The method of claim 9, in which distal ends of the pair of arms are turned inwardly about ninety-degrees toward each other with facing semi-circular slots to substantially form a collar to encircle the golf tee so as to be able to firmly grab a shaft of the golf tee.

17. A golf ball and tee setting and retrieving device, comprising:

a) a hollow main shaft having a handle assembly on a proximate end thereof and a setting and retrieving assembly on a distal end thereof;

b) said setting and retrieving assembly comprising a pair of arms pivoting between a closed position supporting a tee extending therefrom and enclosing a golf ball, and an open position releasing said tee and golf ball;

c) said setting and retrieving assembly including a first spring mounted within said hollow main shaft contacting a push pull member within said hollow main shaft connected to said pair of arms for biasing said pair of arms into said closed position;

d) said handle assembly comprising a housing having a handle, and a trigger extending from said housing;

e) a first slidable rod extending through said hollow main shaft attached at a proximate end thereof to said trigger, said first rod extending to said push pull member for urging said pair of arms into said open position when said trigger is pulled;

f) a ball cup enclosed by said pair of arms for engaging said golf ball;

g) a second slidable rod having a distal end connected to said ball cup extending through said hollow main shaft to and terminating at an adjuster for setting a correct height of said ball cup, said adjuster located adjacent the proximate end of said hollow shaft within said handle assembly;

h) a second spring having a proximal end attached to said adjuster, said adjuster moving said second slidable rod within said hollow main shaft for selecting a desired height of said ball cup;

i) wherein said pair of arms are adapted to place the tee in the ground with the golf ball atop the tee and to retrieve the tee from the ground so that a user avoids bending over.

18. The device of claim 17, in which a first and second bushing serves as a positioning guide for said first and second rods, provides unhindered movement of said first and second rods, and serves as a stop for said first and second springs, respectively.

19. The device of claim 17, in which said first and second rods pass through said first and second springs.

20. The device of claim 17, in which said adjuster comprises a slidable member with a first end engaged with a proximate end of said second rod and a second end having a thumb tab for positioning said slidable member, and a catch for locking said slidable member in a desired position of said slidable member and thereby the desired height of said ball cup, in which said slidable member includes a linear toothed rack, a pawl for engaging said linear toothed rack, and a spring for locking said pawl into engagement with said linear toothed rack.

* * * * *